US005613932A

United States Patent [19]

Focke et al.

[11] Patent Number: 5,613,932

[45] Date of Patent: Mar. 25, 1997

[54] APPARATUS FOR TRANSPORTING HINGE-LID BOXES FOR CIGARETTES

[75] Inventors: Heinz Focke; Martin Stiller, both of Verden, Germany

[73] Assignee: Focke & Co. (GmbH & Co.), Verden, Germany

[21] Appl. No.: 388,420

[22] Filed: Feb. 14, 1995

[30] Foreign Application Priority Data

Feb. 15, 1994 [DE] Germany ..... 44 04 721.5

[51] Int. Cl.[6] ..... B31B 1/62

[52] U.S. Cl. ..... 493/128; 493/89; 493/131; 493/132; 493/147; 53/383.1; 53/376.5; 53/377.4

[58] Field of Search ..... 493/121, 128, 493/89, 111, 114, 115, 126, 127, 130, 131, 132, 147, 151; 156/468, 475, 477.1, 492, 578, 538, 556; 53/383.1, 376.5, 377.4

[56] References Cited

U.S. PATENT DOCUMENTS

| | | | |
|---|---|---|---|
| 4,159,610 | 7/1979 | Langen | 53/377.2 |
| 4,869,769 | 9/1989 | DiRusso, Jr. et al. | 156/475 |
| 5,025,608 | 6/1991 | Marchetti | 493/121 |
| 5,092,108 | 3/1992 | Gottfried | 53/377.4 |
| 5,142,845 | 9/1992 | Maclauchlan | 493/89 |
| 5,228,266 | 7/1993 | Focke | 53/383.1 |

FOREIGN PATENT DOCUMENTS

| | | |
|---|---|---|
| 2809577 | 9/1979 | Germany . |
| 2945980 | 6/1980 | Germany . |
| 2462974 | 8/1984 | Germany . |
| 3108089 | 1/1987 | Germany . |
| 3738102 | 5/1989 | Germany . |
| 4041599 | 6/1992 | Germany . |
| 1071681 | 6/1967 | United Kingdom . |
| 1176733 | 1/1970 | United Kingdom . |
| 2227990 | 8/1990 | United Kingdom . |

*Primary Examiner*—Joseph J. Hail, III
*Assistant Examiner*—Darren Ark
*Attorney, Agent, or Firm*—Sughrue, Mion, Zinn, Macpeak & Seas

[57] ABSTRACT

During the transportation of, if appropriate, partly finished hinge-lid boxes (10) on a pack conveyor (11), an inexact positioning of a lid (14) of the hinge-lid box (10) is frequently undesirable. For this purpose, provision is made for restraining holders (30, 31) which enter into the movement path of the hinge-lid boxes (10) and exert a closure force on the lid (14), which is at the front in the transporting direction, of the hinge-lid box (10). The restraining holders (30, 31) are expediently provided in the region of a glue unit for the hinge-lid boxes.

6 Claims, 3 Drawing Sheets

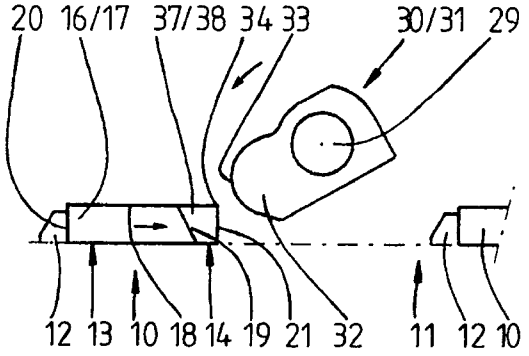
Fig. 3
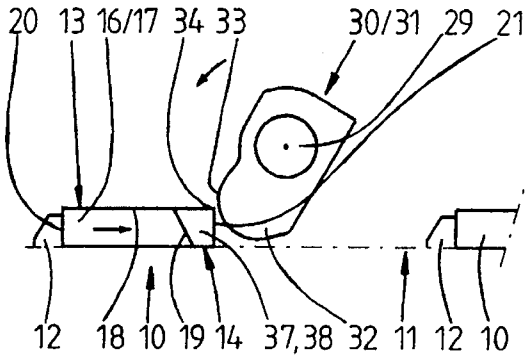
Fig. 4
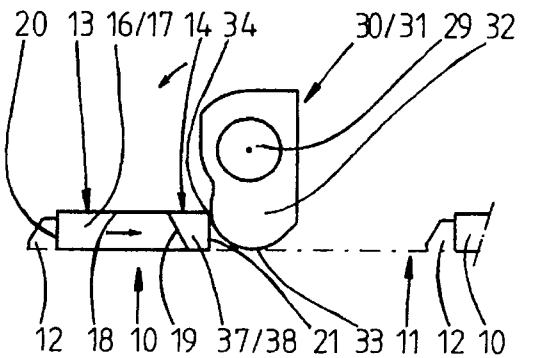
Fig. 5
Fig. 6
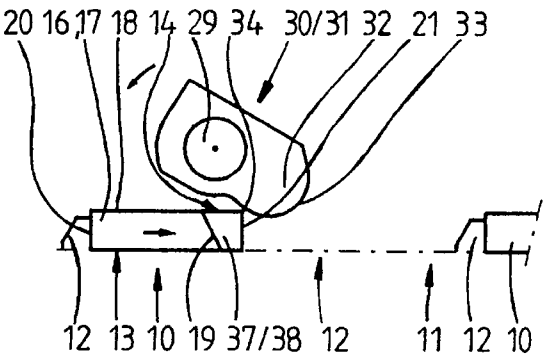
Fig. 7
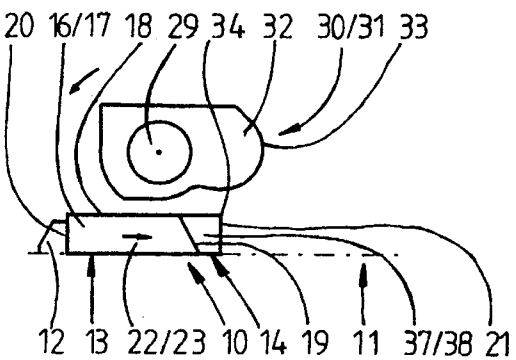
Fig. 8

APPARATUS FOR TRANSPORTING HINGE-LID BOXES FOR CIGARETTES

BACKGROUND OF THE INVENTION

The invention relates to an apparatus for transporting hinge-lid boxes having at least one lid and a box part, in particular in the region of a gluing station for the application of glue onto side tabs and lid side tabs in order to form side walls and lid side walls, it being possible for the hinge-lid box to be transported by drivers, butting against a rear side, of a conveyor, and a base wall and a lid upper wall being oriented transversely with respect to the conveying direction.

Hinge-lid boxes—also called hinge-lid packs are a type of pack for cigarettes which is common throughout the world. The basic construction of a hinge-lid box is such that a box part and a lid are connected to one another in the region of a rear wall and lid rear wall, respectively, such that they can pivot along a hinge line.

It may be necessary, for various reasons, for the wholly or partly finished hinge-lid box to be retained, during the transportation, with the lid in an exact closed position. In said closed position, a free border edge of the lid or of a lid front wall butts against a closure edge of the box part.

The gluing of folding tabs is given by way of example, namely the gluing of outer side tabs and outer lid side tabs, which, together with inner side tabs and inner lid side tabs, form side walls of the box part and lid side walls, respectively. In this arrangement, during the transportation of the largely finished hinge-lid boxes, the transversely projecting outer side tabs and lid side tabs are provided with glue from beneath in the region of a glue station. Glue-application members, in particular glue disks, transfer an application of glue onto the side tabs, on the one hand, and on the lid side tabs, on the other hand. If the lid is not in the correct closed position, a precise application of glue cannot be transferred onto the side tabs and lid side tabs.

SUMMARY OF THE INVENTION

The object of the invention is thus to propose measures which ensure an exact closed position of the lid of a wholly or partly finished hinge-lid box during the transportation of the same.

In order to achieve this object, the apparatus according to the invention is defined in that, at least over a part-section of the transportation of the hinge-lid boxes, in particular in the region of a glue station, restraining holders can be moved into the movement path of the hinge-lid boxes such that, producing a compressive force which retains the lid in the closed position, they butt, during the transportation, against that side of the hinge-lid box which is at the front in the direction of transportation, in particular against the lid upper wall.

Particularly advantageous is an apparatus according to the invention, in the case of which restraining holders are mounted on a rotatably driven shaft which is directed transversely above the movement path of the packs, the movement of the shaft, and thus of the restraining holders, being coordinated with the conveying movement of the hinge-lid boxes.

In the case of a glue station or of a glue unit according to DE 31 08 089, restraining holders are arranged, according to the invention, on the shaft for the mounting and drive of upper restraining disks, that is to say members for pressing the folding tabs (side tabs and lid side tabs) onto the glue-application members. The closure force, acting on the end side of the hinge-lid boxes, that is to say at the front in the direction of transportation, for the lid is accordingly exerted in an exact manner over the short transportation portion in the region of the glue station.

Further details of the invention relate to the special configuration of the restraining holders. An exemplary embodiment of the apparatus according to the invention is illustrated in more detail hereinbelow with reference to the drawings, in which:

DESCRIPTION OF A PREFERRED EMBODIMENT

Figure 1:
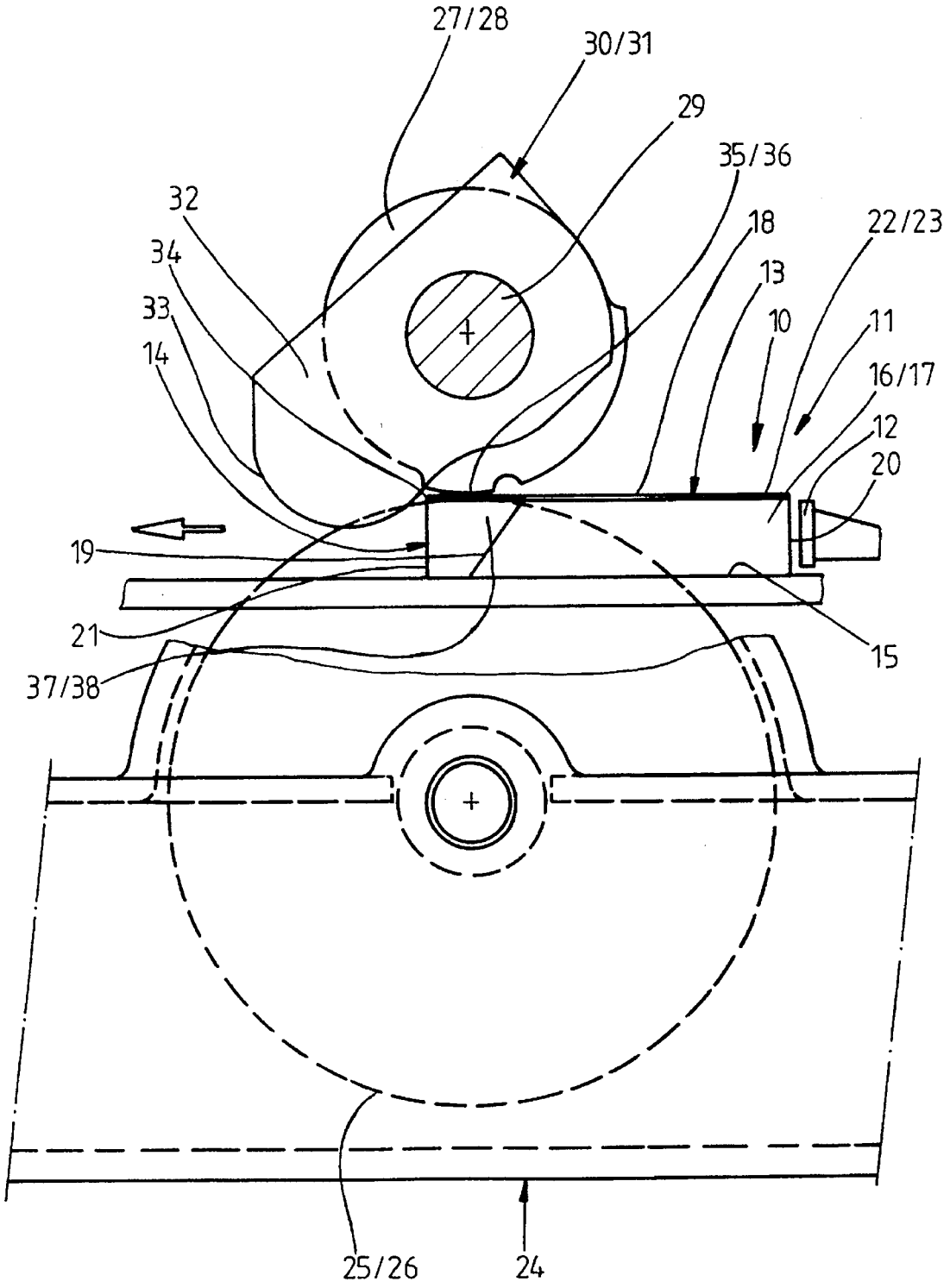
FIG. 1 shows a schematic side view of a glue unit as application example.
Figure 2:
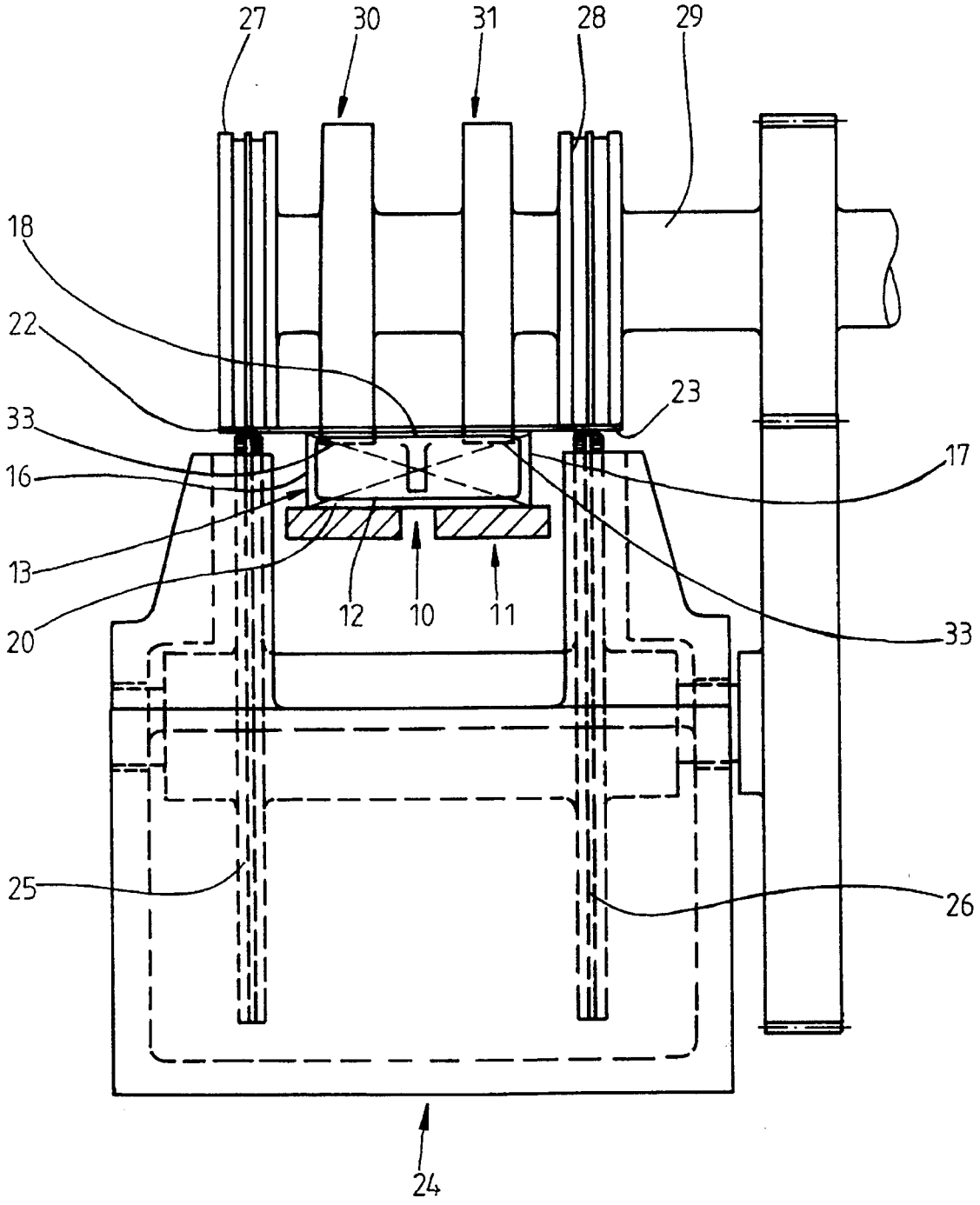
FIG. 2 shows a transverse view of the glue unit according to FIG. 1, and FIG. 3 to FIG. 8 show a side view of different movement phases of a restraining holder for a hinge-lid box.

Shown in the drawings as exemplary embodiment are the construction and mode of operation of a glue station or glue unit as part of a packaging machine for hinge-lid boxes 10 (hinge-lid packs). The hinge-lid boxes 10 are transported rectilinearly and in a horizontal plane in the region of the glue unit by a pack conveyor 11. For this purpose, the pack conveyor 11 exhibits a plurality of drivers 12 which are arranged at regular intervals and are moved continuously and uniformly. The drivers 12 each butt against a rear side of the hinge-lid box 10 (as seen in the conveying direction).

A hinge-lid box 10 usually comprises a box part 13 and a lid 14. Box part 13 and lid 14 are connected to one another in the region of a rear wall 15 of the hinge-lid box 10 such that they can pivot via an articulation line. In the region of side walls 16, 17 and lid side walls 37, 38 and in the region of a front wall 18, the box part 13 and lid 14 are separated from one another by a joint 19. In the region of the side walls 16, 17 and lid side walls 37, 38, the joint 19 is usually directed transversely. On the front wall 18, the joint 19 runs in the transverse direction.

For packaging reasons, the hinge-lid box 10 is positioned on the pack conveyor 11 such that a base wall 20 is directed to the rear. Drivers 12 butt against said base wall. The lid 14 is directed, with a lid upper wall 21, toward the front in the direction of transportation. The front wall 18 is oriented upwards. In the region of the glue unit, sideways-directed folding tabs, namely outer side tabs 22, 23 in the region of the box part 13 and lid side tabs 35, 36 in the region of the lid 14, are each to be provided with glue. The lid side tabs 35, 36 of the lid 14, on the one hand, and the side tabs 22, 23 of the box part 13, on the other hand, are separated from one another by the oblique joint 19. Accordingly, separate applications of glue are transferred onto said part side tabs.

For this purpose, the glue unit is equipped with a glue container 24. Two glue disks 25, 26 rotate, as glue-application members, in said glue container. Said glue disks, in the upper region, transfer applications of glue onto the underside of the side tabs 22, 23 and lid side tabs 35, 36, which, for this purpose, extend in the plane of the front wall 18 of the hinge-lid box 10.

Restraining holders, namely restraining disks 27, 28, are arranged on the upper side, located opposite the glue disks 25, 26. Said restraining disks press the side tabs 22, 23 and lid side tabs 35, 36, from above, against the circumference of the glue disks 25, 26. The restraining disks 27, 28 are arranged on a common shaft 29.

Due to the technological properties of the hinge-lid box 10, namely the material (thin cardboard) and the design, the situation where the lid 14 is not retained exactly in the closed position in the region of the glue station cannot be avoided. This results in the side tabs 22, 23 of the box part 13 and lid side tabs 35, 36 of the lid 14 being at a greater distance from one another than is the case when the lid 14 is in the correct closed position. This leads to incorrect transfer of the application of glue. Measures are thus provided which, at least in the region of the glue station, retain the lid 14 in a precise closed position.

Restraining holders 30, 31 are provided for this purpose. Said holders, over a part-section of the transportation of the hinge-lid boxes 10, are moved into the movement path of the same such that they temporarily butt against the front side of the hinge-lid box 10, that is to say against the lid upper wall 21. The action effected by the restraining holders 30, 31 is such that, together with the drivers 12 of the pack conveyor 11, the hinge-lid box 10 is subjected to a longitudinally directed pressure which secures the closed position of the lid 14.

In the case of the present exemplary embodiment, the restraining holders 30, 31 are mounted rotatably on a shaft, above the movement path of the hinge-lid boxes 10, to be precise on the shaft 29 of the glue unit or of the restraining disks 27, 28 of the same. In the case of the present exemplary embodiment, two restraining holders 30, 31 of matching design are arranged fixedly on the shaft 29. The restraining holders 30, 31 of matching design are in the same angular position and are arranged between the restraining disks 27, 28.

The pivot movement of the restraining holders 30, 31, designed as flat-material webs, is coordinated with the transportation movement of the hinge-lid boxes 10 and the intervals between the same in the region of the pack conveyor 11. The restraining holders 30, 31 are designed as single-armed levers with a supporting part 32 which, in the retaining phase, is lowered from above into the movement path of the hinge-lid boxes 10. On the side directed toward the hinge-lid boxes 10, the supporting part is provided with a round, virtually semicircular supporting edge 33. During the supporting phase, the latter slides along the front side of the hinge-lid box (lid upper wall 21), in doing so transmitting the closure force onto the lid 14. At the beginning of the supporting phase (FIG. 3), the supporting part 32 is lowered into the movement path of the hinge-lid box 10. Upon a pivot movement of the restraining holder 30, 31 in the anti-clockwise direction, the hinge-lid box 10 runs, with an upper edge 34 in the region of the lid upper wall 21, against the supporting edge 33. As the movement of the restraining holder proceeds further, the supporting part 32 moves in the conveying direction with the hinge-lid box 10, the supporting edge 33 always butting against the hinge-lid box 10. The supporting position is effective beyond a vertical position of the restraining holders 30, 31 (FIG. 5) as far as an obliquely directed position of the restraining holders 30, 31 (FIG. 7) in which they are moved gradually out of the supporting position. When the restraining holders 30, 31 have reached the horizontal position according to FIG. 8, the hinge-lid boxes 10 are free and can be transported further.

Accordingly, the restraining function takes place in a lower angular range of the pivot movement. This phase is sufficient in order to transfer the applications of glue onto the side tabs 22, 23 and lid side tabs 35, 36 in an exact manner. When the region of the lid 14 and the bordering region of the box part 13 have left the glue station and the gluing members, the closure pressure for the lid 14 may be removed. Any sub-regions, directed toward the base wall 28, of the side tabs 22, 23 can be glued without a closure force in the region of the lid 14.

The restraining holders 30, 31 may also be used, in this embodiment or in a different embodiment, in other situations, to be precise also for other types of pack.

What is claimed is:

1. An apparatus for transporting, in a conveying direction, hinge-lid packs (10), each having a lid (14) and a pack part (13), in a region of a gluing station, wherein:

a) the lid (14) has a lid front wall, a lid rear wall, a lid top wall (21) and two lid side walls (37, 38); the pack part (13) has a pack front wall, a pack rear wall, a pack bottom wall (20) and two pack side walls (16, 17); and the lid (14) and the pack part (13) are pivotably connected to one another along a hinge line adjacent the lid rear wall and the pack rear wall;

b) said apparatus comprises a pack conveyor (11 ) for transporting the hinge-lid packs in flatly extended position with a longitudinal dimension of each pack extending in the conveying direction, so that the lid top wall (21) and the pack bottom wall (20) extend transversely relative to the conveying direction;

c) said pack conveyor (11) comprises a plurality of drivers (12) for conveying the hinge-lid packs, said drivers (12), for forwarding the hinge-lid packs, resting against the bottom pack wall (20) which faces upstream relative to the conveying direction;

d) said apparatus further comprises a plurality of restraining holders (30, 31) for producing a compressive force for retaining the lid (14) in a closed position; and e) the restraining holders (30, 31) are normally located outside a path of motion of each hinge-lid pack, said apparatus further comprising moving means for temporarily moving the restraining holders (30, 31) into the path of motion for exerting pressure on the lid top wall (21) which faces downstream relative to the conveying direction, such that the restraining holders (30, 31) rest against the lid top wall (21) when the lid (14) is closed during a conveying interval of each pack in the region of the gluing station.

2. The apparatus as claimed in claim 1, wherein said moving means comprises a stationary actuating member, located above the, for moving said restraining holders (30, 31) into and out of the path of motion of each hinge-lid pack (10).

3. The apparatus as claimed in claim 1 or 2, wherein the restraining holders (30, 31) are arranged, on a shaft (29) which is located above the path of motion of the hinge-lid packs (10), transversely with respect to the conveying direction.

4. The apparatus as claimed in claim 3, wherein the restraining holders (30, 31) are directed transversely with respect to the shaft (29), are of a finger-like design, and have a supporting edge (33) which is shaped such that, upon a movement of the restraining holders (30, 31) in the conveying direction of the hinge-lid packs (10), the supporting edge (33) butts against the lid top wall (21) over said conveying interval.

5. The apparatus as claimed in claim 4, wherein the supporting edge (33) has a rounded configuration.

6. The apparatus as claimed in claim 1, further comprising, in the gluing station, a plurality of glue-application members for applying glue to transversely projecting lid outer side tabs (35, 36) and pack outer side tabs (22, 23) for formation of the lid side walls (37, 38) and the pack side walls (16, 17), said glue-application members applying glue to the lid outer side tabs (35, 36) while the restraining holders (30, 31) still exert pressure on the lid (14) and hold it in the closed position.

* * * * *